United States Patent [19]

Molinaro

[11] Patent Number: 4,771,280

[45] **Date of Patent: * Sep. 13, 1988**

[54] ACOUSTICAL VISUAL SOUND DEVICE

[76] Inventor: Bernard J. Molinaro, 294 Elm St., Monroe, Conn. 06468

[ * ] Notice: The portion of the term of this patent subsequent to Sep. 30, 2003 has been disclaimed.

[21] Appl. No.: 861,291

[22] Filed: May 9, 1986

Related U.S. Application Data

[63] Continuation-in-part of Ser. No. 533,151, Sep. 19, 1983, Pat. No. 4,614,942.

[51] Int. Cl.[4] ..... G09G 3/00

[52] U.S. Cl. ..... 340/815.11; 340/754

[58] Field of Search ..... 340/815.11, 753, 754

[56] References Cited

U.S. PATENT DOCUMENTS

| | | | |
|---|---|---|---|
| 3,720,939 | 3/1973 | Polanek | 340/815.11 |
| 3,806,919 | 4/1974 | Comey | 340/815.11 |
| 3,924,231 | 12/1975 | McClure | 340/815.11 |
| 4,614,942 | 9/1986 | Molinaro | 340/815.11 |

*Primary Examiner*—Marshall M. Curtis

[57] ABSTRACT

An acoustical visual sound device used for the visual interpretation of a received acoustical or electrical sound signal having a filter for passing the intelligence contained within a band of frequencies contained within the frequency spectrum of a received sound signal, a multistage amplifier which can be of the automatic gain control type, for amplifying the passed intelligence to a sufficient power level to operate an electro visual means connected at the output thereof throughout its operable visual variable range. The device can be used for pleasure when observing, in visual form, music, voice or other sounds. Or, it can be used as a means for identifying the source of a sound. It is operable in the audio range as well as in the range above and below the audio range. It can contain any number of channels, in which one of the channels can be used as a search or beat channel. And, it responds in visual amplitude variations to both the positive and negative parts of the passed power ampliied intelligence signal.

12 Claims, 1 Drawing Sheet

ELECTRO VISUAL MEANS
AMPLIFIER
FILTER
INPUT
CHANNEL 1
CHANNEL 2
CHANNEL 3
AMPLIFIER
AMPLIFIER
ELECTRO VISUAL MEANS
ELECTRO VISUAL MEANS

AGC AMPLIFIER
TO AGC

MICROPHONE
MICROPHONE AMPLIFIER
OUTPUT
FILTER A
FILTER B
FILTER C
INPUT
AGC CIRCUIT
AGC

ACOUSTICAL VISUAL SOUND DEVICE

This application is a continuation-in-part of my application Ser. No. 06/533,151 filed Sept. 19, 1983 and is now U.S. Pat. No. 4,614,942.

This invention relates to a sound device and more particularly to an acoustical visual sound device.

Present sound devices do not have the means for responding visually in visual amplitude variations to the instantaneous amplitude variations of the intelligence signal contained within the frequency spectrum of a received sound signal, whether or not the sound signal is electrical or acoustical, which will permit the visual interpretation of the said received sound signal.

Present sound devices that use a visual display, respond in an on-off fashion to the received sound signal. They use an SCR or a triac which is an electronic switch that can only respond in an on-off fashion. And, in operation, the visual display responds to the constant amplitude signal, which has a duration that is dependent upon the magnitude of a half wave detected signal. Therefore, they do not respond in visual amplitude variations directly to the instantaneous amplitude variations of the received sound signal including the positive and negative parts of the received sound signal. Rather, they respond to an average value of only half of the wave of the received sound signal. Also, they do not respond to the amplitude variations of the actual sound signal. Rather, they respond to the variations of a modulated signal. Other visual sound devices merely respond to timing devices and therefore they only simulate a response to an audio sound.

It is an object of the present invention to produce an acoustical visual sound device that is an improvement over present sound devices that work with a visual output. Said device being simpler in construction, uses a minimum number of parts, is more efficient in operation and responds to sound signals that are acoustical, audio, or electrical sound signals, including sound signals that are above and below the audio sound range. The device also responds to the instantaneous amplitude variations of the positive going part of the sound signal as well as the negative going part of the sound signal.

It is another object of the present invention to produce an acoustical visual sound device as described above, that has means for responding visually in visual amplitude variations to the instantaneous amplitude variations of the intelligence signal contained within a band of frequencies contained within the frequency spectrum of a received sound signal, which permits the visual interpretation of the said received sound signal, which can be in the form of an acoustical, electrical or an audio electrical sound signal.

Another object of the present invention is to produce an improved visual sound device that has means for searching within a band of frequencies of a received acoustical, electrical or audio electrical sound signals for particular bits of intelligent information and display this intelligence visually.

Another object of the invention is to produce an acoustical visual sound device, which is an improvement over present devices, that will visually reproduce the intelligence contained within the different bands of frequencies contained within a received acoustical, electrical or audio electrical sound signal. Said acoustical visual sound device not being limited to responding to bands of frequencies contained within the audio frequency range but, also includes bands of frequencies contained above and below the audio frequency range.

Still another object of the present invention is to provide an acoustical visual sound device as described with means for automatically controlling the gain of the said device. The said means compensates for changes in strength of the received sound signal so that an operator will not have to continually adjust the gain of the device. The said device so constructed responds visually in visual amplitude variations, not merely to the change in strength of the received sound signal. Rather, it will respond in visual amplitude variations directly with the amplitude variations of the said passed intelligence that has been compensated for changes in strength of the said received electrical sound signal.

These together with other objects and advantages which will become subsequently apparent resides in the details of construction and operation as more fully hereinafter described and claimed, reference being had to the accompanying drawing forming a part hereof, wherein like numerals refer to like parts throughout, and in which:

Figures 1, 2, 3, 4, 5:
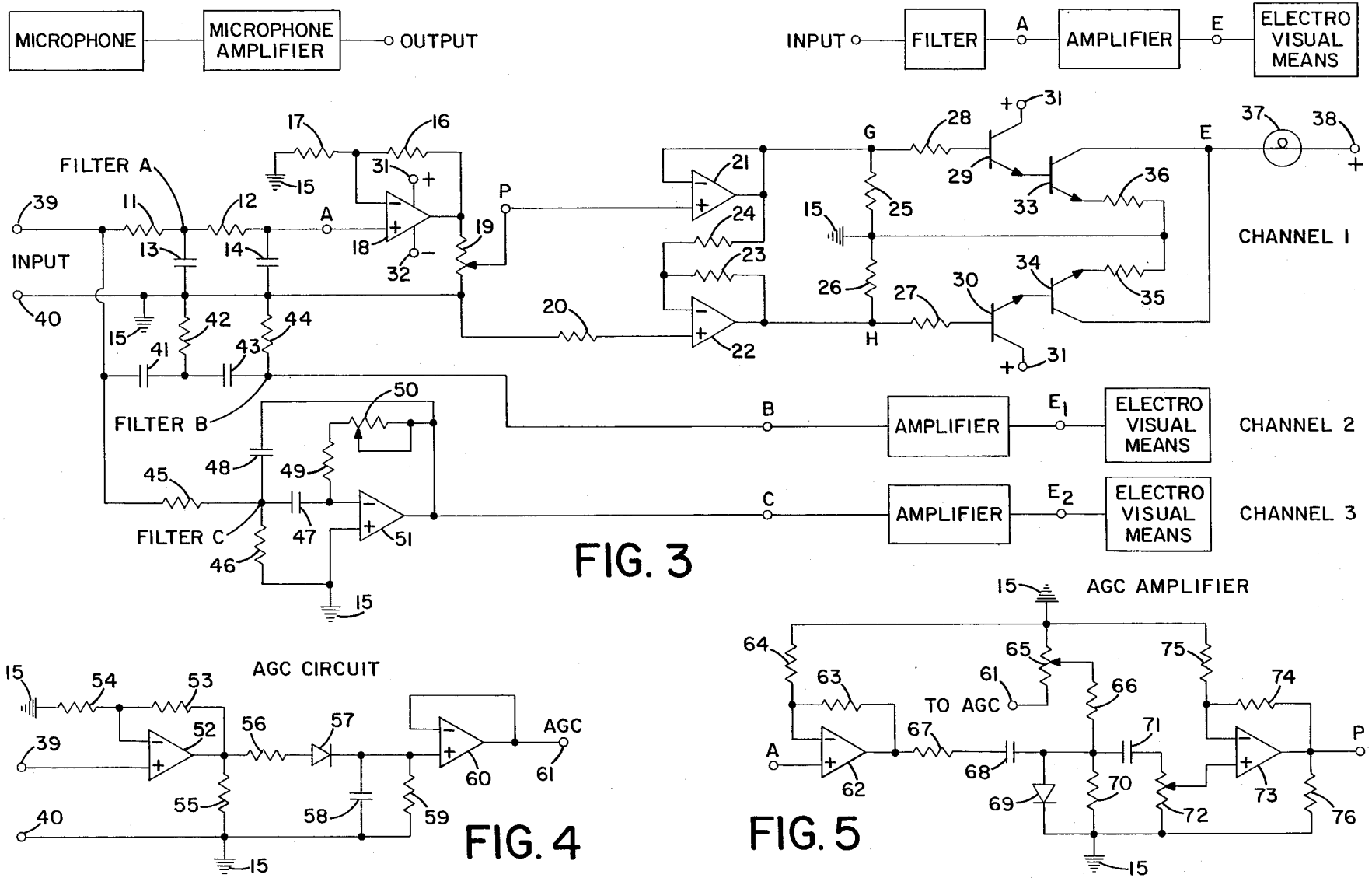
FIG. 1 is a block diagram of the components of the invention whether considered as the method or the operation.
FIG. 2 is a block diagram of a microphone and a microphone amplifier which can be used as a source of the electrical sound signal.
FIG. 3 is a schematic diagram of the acoustical sound device made in accordance with one form of the present invention.
FIG. 4 is a schematic diagram of a circuit used for generating an Automatic Gain Control, AGC, voltage.
FIG. 5 is a schematic diagram showing an Automatic Gain Control Amplifier which can be used as a modification to the circuit of FIG. 3.

Referring now more in detail to FIG. 1 of the drawing there is provided one channel of the basic invention which consists of an input adapted to receive an electrical sound signal. The electrical sound signal passes through a filter which passes the intelligence signal contained within a band of frequencies contained within the frequency spectrum of the received sound signal. The passed intelligence signal is then power amplified by means of any suitable amplifier to a sufficient power level to operate an electro visual means which is connected at the output of the amplifier. The electro visual means converts the power amplified intelligence signal into a visual amplitude varying output that follows the instantaneous amplitude variations of both the positive and negative parts of the passed intelligence that was passed by the filter. The electro visual means can be any electro visual means, such as: a spotlight, a low voltage lamp, an oscillograph, a strip chart recorder, a laser or any other electro visual means including a halograph display. In this form of the invention a spotlight was used as the electro visual means. The amplifier used can be any suitable linear amplifier. It can be an AC or a DC amplifier; it can be a multistage amplifier with a linear Class A power amplifier at the output or it can have a Class A, Class AB or Class B push-pull amplifier at the output. It could be a Class A or a push-pull power amplifier that contains a bias for biasing a lamp or spotlight or other electro visual means so that it is just on the verge of operating throughout its operable brightness or variable visual range. Therefore, the lamp or other electro visual means will begin to operate in brightness or vary visually with the very minimum of signal applied. Also, any other type of a power amplifier can be used, including a modified form of the push-pull amplifier as described in FIG. 3. The modified push-pull amplifier of FIG. 3 can also be used with the bias feature for biasing the electro visual means if desired, by including in both halves of the push-pull amplifier, the rectifier circuit, the voltage follower and bias as shown and described in my original patent application. However, the electro visual means would remain connected as shown in FIG. 3.

The acoustical visual sound device described in this invention is powered by an appropriate power supply to feed the various units used. Also, the amplifiers described and used can be of the Automatic Gain Control type.

FIG. 1 as described above and shown in the drawing, illustrates the basic components of one channel of the invention. The invention can be made up of any number of channels. Each of the channels would use similar components. Each channel, therefore, would consist of a filter, an amplifier and an electro visual means. However, each channel would preferably use a different filter so that different bands of frequencies would be passed by each of the filters. Therefore, each of the electro visual means would respond to the intelligence passed by the filters contained in their respective channels. The filters used could be any suitable filters, such as: a low pass, a high pass, a band pass, or a notch filter. They can be active filters or passive filters. They can be of the RC type or an LC type. That is any kind of a filter that can be adapted to pass a desired band of frequencies contained within the frequency spectrum of the received electrical sound signal can be used.

Refer now to FIG. 2. In FIG. 2 there is shown in block diagram form a microphone which can be any suitable microphone or pickup, such as a crystal or dynamic microphone or any other type of a device which can convert an acoustical sound signal into an electrical sound signal, including a speaker, can be used. The microphone can be directional or omnidirectional, depending on the particular use. The output of the microphone is connected to a microphone amplifier, such as a pre amplifier or any suitable amplifier that can raise the low level electrical sound signal present at the output of the microphone to a suitable level to be useful as a source of an electrical sound signal for the invention described. Therefore, at the output of the amplifier there would be an electrical sound signal which varies in amplitude, both in the positive and negative direction, directly with the amplitude variations of the acoustical sounds picked up by the microphone. The microphone and the microphone amplifier, when used as a source of an electrical sound signal, increases the usefulness of the invention because in those applications where it is difficult to get a convenient source of an electrical sound signal, then the unit can generate its own electrical sound signal. An example of one of the uses would be in those cases where there is a band or an orchestra in which many of the instruments uses a different amplifier. Therefore, there would be two or more outputs that have an electrical sound signal present to hook up to. In this case it would be difficult to connect the acoustical visual sound device input to the two or more output sources of an electrical sound signal. However, by using the microphone and the amplifier as described, the device would be able to respond to all of the outputs without any electrical connections to the electrical sound signals present at the output of each of the amplifiers used by the band or the orchestra. Therefore, the invention would be self contained. And, merely placing the microphone in a suitable location to the sound sources would be sufficient to pickup the acoustical sounds produced from the various speakers or instruments or other acoustical sounds produced. Without the microphone and amplifier features described in FIG. 2 it would be necessary to use the more complicated arrangement of a mixer which is connected through a number of electrical connections to each of the outputs that are used to amplify the various instruments that are used in the band or orchestra.

Refer now to FIG. 3. In FIG. 3 we show one form of an acoustical visual sound device that consists of three similarly constructed channels. Each of the channels contains a different filter. Channel 1 has a low pass filter designated as Filter A. Channel 2 has a high pass filter designated as Filter B. And, Channel 3 has a bandpass filter designated as Filter C. Filter C also has provisions for varying the center frequency. Therefore, it is a variable bandpass filter. Filter A and Filter B are passive filters and Filter C is an active filter. As described above, any type of filters could be used in each of the channels of the invention. Also, in this form of the invention, we used only 3 channels. However, any number of channels could be used, with each of the channels using a different filter to pass a different band of frequencies in each of the channels used. For example: we could use another channel using an active bandpass filter similar to Filter C. However, the resistor 49 and the potentiometer 50 could be replaced with a fixed resistor. Therefore, this fourth channel would be a fixed bandpass active filter. Filter C as used in this form of the invention is a variable bandpass active filter. This variable feature permits an operator to search for particular bits of information contained within the frequency spectrum of the received electrical sound signal, such as, the beat of a drum or the strum of a guitar or any other information. The circuit can be used as a search circuit or by searching for a beat of a drum or the strum of a guitar or any other beat, it can be used as a beat circuit. Also, the device shows a multi stage amplifier connected at the ouptut of the filters. It is clearly understood that part of the multi stage amplifier could be connected before the filter and part of the amplifier, such as the power stage could be connected at the output of the filters. It is also understood that the invention could have the input connected to one common amplifier. The output of the common amplifier would then feed the inputs of all the filters and a power amplifier would be connected at the output of each of the filters. In this way we could eliminate some of the amplifier stages. However, using the device as shown gives more flexibility. Therefore, any suitable combination of filters and amplifiers or modifications can be made and would fall within the scope of this invention. FIG. 3 is merely one form of the invention. In this form of the invention the input 39 and 40 would be any suitable connector for attaching to or receiving a source of an electrical sound signal. The source of the electrical sound signal could be the output of the microphone and the microphone amplifier as described in FIG. 2 or it could be the output of a stereo amplifier, a radio, a phonograph, a tape system, a public address system, or the output of any amplifier or electrical device that contains an electrical sound signal. The electrical sound signal can be in the audio range or contain frequencies above and below the audio range. Thereby, the device could be used for interpreting visually signals in the audio range as well as those sound signals above and below the audio range. The device so constructed can be used for pleasure when used for vewing the sound signals, such as, when vewing the sounds at the output of a stereo amplifier. Or, it can be used as a means for identifying the source of the sound, since each source of the sound signals would have a particular visual output pattern, which can be used as a means of identifying the source of the sound. For example: a particular truck would have a particular sound which could be interpreted visually. A different truck or a car would have a different sound that would have a different visual pattern. Therefore, by cataloging the visual patterns of known devices or sound sources, it would be possible to identify the source.

The inputs of each of the filters shown in FIG. 3 are connected to the input 39 and 40. Therefore, the input 39 and 40 is a common input for each of the channels. Filter A of channel 1 is a passive low pass filter. It consists of two resistor—capacitor sections. Resistor 11 and capacitor 13 being one section and resistor 12 and capacitor 14 being the second section. Filter A being a low pass filter allows only the intelligence signal contained within the low frequency band of the overall frequency spectrum of the received electrical sound signal to pass. The output of Filter A is indicated on the diagram at A in FIG. 3 and also in FIG. 1. The output A is with reference to the signal and power ground 15. The output A of Filter A is connected to the noninverting input of the operational amplifier 18. The point A with respect to ground 15 is also the input to the multistage amplifier which consists of a linear amplifier and a modified push-pull amplifier connected as the output stage of the amplifier. The output of the power amplifier is indicated in the drawing as point E which would be referenced to ground 15. Connected at the output E of the push-pull amplifier is an electro visual means which is used for displaying the power amplified intelligence signal contained at the output of the modified push-pull amplifier.

The multistage amplifier which is connected between the points A and E in this form of the invention, consists of the operational amplifier 18 which is connected as a noninverting amplifier with its gain determined by the value of the resistors 16 and 17. Connected at the output of this circuit is a potentiometer 19 which functions as a manual gain control with its output being indicated at P in the drawing. The output P of the amplifier would be referenced to ground 15. The output P is then connected to the noninverting input of operational amplifier 21. Operational amplifier 21 and 22 are operated as a phase inverter for generating two equal voltages in phase opposition, which is needed for driving the push-pull amplifier input. Operational amplifier 21 is connected as a voltage follower with its output at G. Operational amplifier 22 is connected as an inverting amplifier with a unity gain. The gain being determined by the resistors 23 and 24. The resistor 20 in this circuit is the current compensating resistor. The input of the inverting amplifier is connected to the output G of the voltage follower. And, the output of the inverting amplifier is designated at H on the drawing. Therefore, the signal at H would be 180 degrees out of phase with the signal at G. Connected across the output of the phase inverter circuit are the load resistors 25 and 26 with their common point grounded. The signal at the output of the phase inverting circuit is used to drive the modified push-pull amplifier which consists of the resistors 27 and 28, the transistors 29 and 30, the power transistors 33 and 34, the resistors 35 and 36. This type of push-pull amplifier does not use a center tap transformer at its output because the load 37, in this form of the invention is a spotlight which operates just as well with a signal that is positive going only, as well as a positive and negative going signal. Therefore, this circuit is ideally suitable to this type of load. However, if the load is such as to require both a positive and a negative going signal then a conventional push-pull Class A, Class AB or Class B circuit could be used, in which the output may or may not be of the type that uses a center tapped transformer connected at its output. The circuit used in this form of the invention has the advantage of being more efficient, has a minimum number of parts, has a better response and many other advantages. The transistors 29 and 33 as well as the transistors 30 and 34 are connected in a darlington type arrangement. Therefore, transistors 29 and 30 could be low voltage operated transistors, which in this circuit is shown as the plus voltage 31, while the transistors 33 and 34 are power transistors which require a higher voltage, designated as the plus voltage 38 for their operation. The output of the amplifier is designated at E on the drawings of FIG. 3 and FIG. 1. The electro visual device 37 used in this form of the invention is a spotlight which converts the amplitude variations of the push-pull output current into a visual amplitude varying output that follows the instantaneous amplitude variations of the output current. And, since the output current of the push-pull amplifier varies in amplitude to the amplitude variations of the filtered electrical sound signal, then the electro visual means 37 will in effect vary in visual amplitude variations directly with the instantaneous amplitude variations of both the positive and negative parts of the passed intelligence signal.

In this form of the invention, the electro visual means used in each of the three channels was a spotlight. The spotlights used were of different colors to increase the usefulness of the device and also, to give a more pleasant effect. Although, the spotlights used could all be of the same color, the use of different colors has the advantage of giving more information to the user.

In channel 2 of the circuit, a different filter designated as Filter B was used. Filter B is a high pass filter. It consists of a two stage capacitor resistor passive filter. Capacitor 41 and resistor 42 being the first stage and capacitor 43 and resistor 44 being the second stage. The output of Filter B is identified at B on the drawing. The output of Filter B drives the amplifier circuit of channel 2, which is constructed the same as the amplifier circuit of channel 1. The output of the channel 2 amplifier also, has a spotlight connected at its output. It is connected in the amplifier circuit the same as described for channel 1. The parts of the circuit that are constructed the same as channel 1 are represented in the drawing in block diagram form.

Channel 3 uses an active narrow bandpass filter. Its center frequency can be varied manually by the user. It is indicated in the drawing as Filter C. It consists of resistors 45, 46, 49 and potentiometer 50, capacitors 47, 48 and operational amplifier 51. Point C being the output of Filter C. This point is also the input to the amplifier of channel 3 which drives the electro visual means of channel 3. The amplifier and electro visual means of channel 3 are also constructed the same as the amplifier and electro visual means described in channel 1. Therefore, they are also represented in block diagram form. The center frequency of the filter is adjustable by means of the potentiometer 50. Varying the potentiometer 50 causes a change in the center frequency of the filter. In use, the operator would vary the potentiometer 50 to search for a particular bit of intelligence, contained within the band of frequencies covered by the filter. This feature produces in the device, the advantage of being able to search for the beat of a drum, a particular note on a piano, a singers voice etc., when the device is used as an audio visual sound device. When the device is used for identification purposes, sounds above, below and including the audio bands of frequencies can be searched for particular bits of intelligence to help the user to more easily identify visually the source of the sound. Although, this circuit used the resistor capacitor active circuit described above, any type of a variable bandpass filter could be used here, including an LC active or passive type of a filter.

FIG. 4 described as an AGC circuit on the drawing is used for generating an Automatic Gain Control Voltage designated as AGC on the drawing at the output 61. The AGC circuit consists of operational amplifier 52 connected as a noninverting amplifier with its gain determined by the resistors 53 and 54. The noninverting input of the amplifier is connected to a source of the electrical sound signal through the input terminals 39 and 40. The output of the amplifier is connected to the detector circuit consisting of resistor 56, diode 57, capacitor 58 and resistor 59. Resistor 55 is shown as a load resistor. The output of the rectifier circuit is connected to the noninverting input of operational amplifier 60, which is connected as a voltage follower. The output 61 of the voltage follower contains the DC AGC voltage. The AGC voltage is used to control the gain of an Automatic Gain Control amplifier such as the AGC amplifier of FIG. 5.

FIG. 5 is one form of an Automatic Gain Control (AGC) amplifier that can be used as a modification to the amplifier circuits of FIG. 3. For example, each of the amplifiers can use the AGC amplifier of FIG. 5 as a substitute for the fixed gain amplifiers connected between the outputs of the filter to the input of the phase inverting circuit. In the drawing, FIG. 5 is shown to agree with the letters A and P of channel 1. However, it is understood that all the channels used could use this type of AGC amplifier. Or, any other suitable AGC amplifier could be used. This type of an AGC amplifier consists of a two stage amplifier that consists of operational amplifiers 62 and 73. The output of Filter A, designated as A on the drawing is applied to the noninverting input of operational amplifier 62, which is connected as a noninverting amplifier with its gain determined by the values of resistors 63 and 64. Operational amplifier 73 is also connected as a noninverting amplifier with its gain determined by the values of resistors 74 and 75. The gain of both amplifiers being designed so that both of the amplifiers will operate within their linear region. The two amplifiers, which are used to amplify the passed intelligence signal, are interconnected through an Automatic Gain Control network consisting of resistor 67, capacitor 68, diode 69, resistor 70, resistor 66, potentiometer 65, capacitor 71 and potentiometer 72. The AGC network used in this form of the invention works as follows: The resistance of diode 69 changes with an increase or decrease in its current and, since the diode 69 is part of an impedance ladder network, the intelligence signal drop across the diode will increase or decrease with an increase or decrease of its resistance. When the AGC voltage applied to potentiometer 65 at input 61 increases, it causes an increase of DC current through diode 69. The increase in diode current causes a decrease in the diode resistance. And, because of the voltage divider principle applied in ladder networks, the intelligence signal, which is an AC signal will decrease with the decrease in the diode resistance. This decrease in the intelligence voltage causes an effective drop in the gain of the amplifier stages interconnected thereby. The reverse action occurs when the AGC voltage decreases. This results in an increase of diode resistance with a resultant increase in the intelligence signal across the diode. The resistance 70 connected in parallel with diode 69 helps to linearize the voltage drop across the parallel combination. Capacitor 68 and 71 act as blocking capacitors to the DC AGC voltage applied to the diode 69. Potentiometer 65 is adjusted to the desired gain with maximum usable sound signal present at the input of the device. Manual gain control for the channel is accomplished by means of potentiometer 72, which has its arm connected to the noninverting input of operational amplifier 73.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention as claimed.

Having thus completely and fully described the invention, what is now claimed as new is as follows:

1. An acoustical visual sound device for use in the visual interpretation of a received electrical sound signal containing at least one channel that responds visually in amplitude variations with the amplitude variations of the intelligence contained within a band of frequencies of the said received electrical sound signal, said channel consisting of a frequency responsive filter means having its input adapted to receive a source of the said received electrical sound signal and the said filter means in response thereto passes the intelligence, contained within a band of frequencies of the said received electrical sound signal, to the input of a full wave amplifying means which amplifies the said passed intelligence to a sufficient power level to operate an electro visual means connected at the output thereof throughout its operable brightness range in correspondence with the amplitude variations of the said power amplified passed intelligence, thereby converting the said received electrical sound signal into a visual amplitude varying output that follows the amplitude variations of the said passed intelligence.

2. An acoustical visual sound device for use in the visual interpretation of a received electrical sound signal as described in claim 1, in which the said acoustical visual sound device contains at least two of the said channels in which the bandpass of each of the said filter means is different and thereby different intelligence is passed to each of the said amplifying means contained in each of the said channels.

3. An acoustical visual sound device for use in the visual interpretation of a received electrical sound signal as described in claim 2, in which the said amplifying means contained in each of the said channels is a multistage amplifier consisting of: a linear amplifier connected to the output of the said filter means for amplifying the said passed intelligence, the output of the said linear amplifier being connected to the input of a power amplifier which power amplifies the said amplified passed intelligence to a sufficient power level to operate an electro visual means connected at the output thereof throughout its operable brightness range in correspondence with the amplitude variations of the said power amplified passed intelligence, thereby converting the said received electrical sound signal into a visual amplitude varying output that follows the amplitude variations of the said passed intelligence.

4. The invention as described in claim 3, in which the said linear amplifiers connected at the output of each of the said filter means are of the automatic gain control (AGC) type in which the said gain of each of the said automatic gain control amplifiers is responsive to the change in strength of the said received electrical sound signal in an inverse proportional manner, whereby an increase in the strength of the said received electrical sound signal produces a decrease in the gain of the said automatic gain control amplifiers and a decrease in the strength of the said received electrical sound signal produces an increase in the gain of the said automatic gain control amplifiers, and thereby the said automatic gain control amplifiers compensates for the changes in strength of the said received electrical sound signal and maintains the relative strength of the said passed intelligence passed in each of the said channels, then in each of the said channels each of the said electro visual means being responsive thereto, converts the said power amplified passed intelligence into a visual amplitude varying output that follows the amplitude variations of the said passed intelligence which has been compensated for the change in strength of the said received electrical sound signal.

5. The invention as described in claim 4, in which the said electro visual means connected at the output of each of the said power amplifiers is a spotlight, in which each spotlight is preferably of a different color and in which each spotlight is connected and adapted to operate, as the load for the said power amplifier, throughout its operable brightness range in correspondence with the said amplitude variations of the said power amplified passed intelligence, thereby converting the said received electrical sound signal into a visual amplitude varying output that follows the amplitude variations of the said passed intelligence passed in each of the said channels.

6. The invention as described in claim 2, in which the said filter means contained in one of the said channels for passing the intelligence contained within a band of frequencies of the said received electrical sound signal is a low pass passive resistance capacitance filter which in response to a received electrical sound signal passes the intelligence contained within the low band of frequencies of the said received electrical sound signal to the input of one of the said amplifying means which is connected at the output thereof, and the said filter means contained within another of the said channels for passing the intelligence contained within a band of frequencies of the said received electrical sound signal is a high pass, passive resistance capacitor filter which in response to a received electrical sound signal passes the intelligence contained within a high band of frequencies of the said received electrical sound signal to the input of another one of the said amplifying means which is connected at the output thereof, the inputs of both of the said filter means being similarly adapted to be connected to a source of the said received electrical sound signal.

7. The invention as described in claim 2, in which at least one of the said filter means contained in one of the said channels for passing the intelligence contained within a band of frequencies of the said received electrical sound signal is an active bandpass filter in which the input of the said active bandpass filter is adapted to be connected to a source of the said received electrical sound signal and the output of the said active bandpass filter is connected to the input of one of the said amplifying means which amplifies the said passed intelligence to a sufficient power level to operate an electro visual means connected at the output thereof throughout its operable brightness range in correspondence with the amplitude variations of the said power amplified passed intelligence, thereby converting the said received electrical sound signal into a visual amplitude varying output that follows the amplitude variations of the said passed intelligence passed by the said active bandpass filter.

8. The invention as described in claim 2, in which at least one of the said means contained in one of the said channels used for passing the intelligence contained within a band of frequencies of the said received electrical sound signal is an active narrow bandpass filter of the variable center frequency type, the input of the said active narrow bandpass filter is adapted to be connected to a source of the said received electrical sound signal and the output of the said active narrow bandpass filter is connected to the input of one of the said amplifying means which has an electro visual means connected at the output thereof, the said active narrow bandpass filter of the variable center frequency type in response to the said received electrical sound signal passes the intelligence, contained within a variable narrow band of frequencies contained within the frequency range of the said received electrical sound signal, to the said amplifying means which amplifies the said passed intelligence to a sufficient power level to operate an electro visual means connected at the output thereof throughout its operable brightness range in correspondence with the amplitude variations of the said power amplified passed intelligence, thereby converting the said received electrical sound signal into a visual amplitude varying output that follows the amplitude variations of the said passed intelligence passed by the said narrow bandpass filter of the variable center frequency type.

9. The invention as described in claim 2, in which at least one of the said filter means contained in one of the said channels used for passing the intelligence contained within a band of frequencies of the said received electrical sound signal is an active narrow bandpass filter of the variable center frequency type in which the said center frequency is manually variable to permit an operator to manually vary the center frequency of the said active narrow bandpass filter, and thereby the said operator can manually search for particular bits of sound information contained within the frequency range of the said received electrical sound signal, the input of the said active narrow bandpass filter is adapted to be connected to a source of the said received electrical sound signal and the output of the said active narrow bandpass filter is connected to the input of one of the said amplifying means which has an electro visual means connected at the output thereof, the said active narrow bandpass filter in response to the said received electrical sound signal passes the intelligence contained within a manually variable narrow band of frequencies contained within the frequency range of the said received electrical sound signal, to the said amplifying means which amplifies the said passed intelligence to a sufficient power level to operate the electro visual means connected at the output thereof throughout its operable brightness range in correspondence with the amplitude variations of the said power amplified passed intelligence, thereby converting the said received electrical sound signal into a visual amplitude varying output that follows the amplitude variations of the said passed intelligence passed by the said narrow bandpass filter of the manually variable center frequency type.

10. An acoustical visual sound device for use in the visual interpretation of a received electrical sound signal as described in claim 2, having its input connected to the output of a microphone amplifier which has a microphone connected at the input thereof, said microphone in response to a received acoustical sound signal converts the said received acoustical sound signal into a low level electrical sound signal which is then amplified by means of the said microphone amplifier to a sufficient level to operate the said acoustical visual sound device which is connected at the output thereof, and thereby the said acoustical visual sound device converts the said received acoustical sound signal into a visual amplitude varying output that follows the amplitude variations of the said passed intelligence.

11. A visual sound device for use in the visual interpretation of a received electrical sound signal consisting of a plurality of channels in which each of the said channels has a filter means which is frequency responsive to the said received electrical sound signal for passing the intelligence contained within a band of frequencies of the said received electrical sound signal, means responsive to the said passed intelligence for amplifying the full wave of the said passed intelligence to a sufficient power level to operate an electro visual means connected at the output thereof throughout its operable visual variable range in correspondence with the amplitude variations of the said power amplified passed intelligence, thereby converting the said received electrical sound signal into a visual amplitude varying output that follows the amplitude variations of the said passed intelligence.

12. An acoustical visual sound device for use in the visual interpretation of a received electrical sound signal as described in claim 11, having its input connected to the output of a microphone amplifier which has a microphone connected at the input thereof, said microphone in response to a received acoustical sound signal converts the said received acoustical sound signal into a low level electrical sound signal which is then amplified by means of the said microphone amplifier to a sufficient level to operate the said acoustical visual sound device which is connected at the output thereof, thereby the said acoustical visual sound device converts the said received acoustical sound signal into a visual amplitude varying output that follows the amplitude variations of the said passed intelligence.

* * * * *